US007513477B2

(12) United States Patent
Lampert

(10) Patent No.: US 7,513,477 B2
(45) Date of Patent: Apr. 7, 2009

(54) ADJUSTABLE HANGING DEVICE

(76) Inventor: Todd Lampert, 46 Main St., New Canaan, CT (US) 06840

( * ) Notice: Subject to any disclaimer, the term of this patent is extended or adjusted under 35 U.S.C. 154(b) by 0 days.

(21) Appl. No.: 11/695,752

(22) Filed: Apr. 3, 2007

(65) Prior Publication Data

US 2007/0235620 A1 Oct. 11, 2007

Related U.S. Application Data

(60) Provisional application No. 60/790,403, filed on Apr. 7, 2006.

(51) Int. Cl.
*A47G 1/16* (2006.01)

(52) U.S. Cl. ..... 248/493; 248/489; 248/497; 248/498; 248/475.1; 248/466; 40/757

(58) Field of Classification Search ..... 248/489, 248/493, 497, 498, 475.1, 466; 40/757
See application file for complete search history.

(56) References Cited

U.S. PATENT DOCUMENTS 231,319 A * 8/1880 Holbrook ..... 24/135 N
358,069 A * 2/1887 Pratt ..... 24/135 N
550,456 A * 11/1895 Nealy ..... 24/115 H
856,512 A * 6/1907 Bowers ..... 403/209
1,147,863 A * 7/1915 Hickerson et al. ..... 248/489
1,455,961 A * 5/1923 Maier ..... 248/493
1,545,889 A * 7/1925 Everson ..... 24/136 R
1,792,326 A * 2/1931 Samard ..... 248/493
3,547,389 A * 12/1970 Mitchell ..... 248/216.1
3,564,670 A * 2/1971 Bengtsson ..... 403/390
4,003,539 A * 1/1977 Gutner ..... 248/489
4,775,127 A * 10/1988 Nakamura ..... 248/489
5,100,094 A * 3/1992 Handwerger et al. ..... 248/489
5,207,404 A * 5/1993 Reinhard ..... 248/217.4
6,966,534 B2 * 11/2005 Kamenstein et al. ..... 248/493

* cited by examiner

*Primary Examiner*—J. Allen Shriver, II
*Assistant Examiner*—Michael McDuffie
(74) *Attorney, Agent, or Firm*—Perman & Green, LLP

(57) ABSTRACT

A device for hanging an object on a surface. The device includes a body portion, a channel, a locking member and an attachment member. The channel passes through the body portion and is configured to receive an elongated connecting member. The locking member protrudes into the channel and is configured to releasably engage the elongated connecting member and prevent the elongated connecting member from passing through the channel when engaged. The attachment member is connected to the body portion and is configured to attach the body portion to the object to be hung.

20 Claims, 5 Drawing Sheets

ADJUSTABLE HANGING DEVICE

This application claims the benefit of U.S. Provisional Application No. 60/790,403, entitled "ADJUSTABLE HANGING DEVICE" and filed on Apr. 7, 2006.

BACKGROUND

1. Field

The present embodiments relate to hanging devices and, more particularly, to adjustable hanging devices.

2. Brief Description of Related Developments

Current hanging devices such as for picture frames or any other item a user would desire to hang on a surface provide the user with a predetermined length of cord to hang the item. For example, if the user places a picture too high or too low on the wall the user must either relocate the nail, screw or hanger to a higher or lower location on the wall or untie the cord from the picture and guess at what length of cord would provide the correct height. In the case where the nail, screw or hanger is moved the user ends up with several holes in the wall depending on how many times it takes the user to obtain the correct height. In addition to making undesirable holes in the wall both methods of adjusting the height of the item are time consuming and are a process of trial and error.

It would be advantageous to have a hanging device that would allow adjustment of an item to be hung on a surface without any guesswork on the part of the user or the creation of undesirable holes in the surface.

SUMMARY

In one embodiment, a device for hanging an object on a surface is provided. The device includes a body portion, a channel, a locking member and an attachment member. The channel passes through the body portion and is configured to receive an elongated connecting member. The locking member protrudes into the channel and is configured to releasably engage the elongated connecting member and prevent the elongated connecting member from passing through the channel when engaged. The attachment member is connected to the body portion and is configured to attach the body portion to the object to be hung.

In another embodiment, a method of hanging an object on a surface is provided. The method includes attaching a first hanging device to an object to be hung, wherein the hanging device includes a body portion, affixing a first end of the elongated connecting member to the object to be hung, inserting a second end of the elongated connecting member into a channel of the first hanging device, placing a crest of the elongated connecting member over a mounting point located on a surface for hanging the object, adjusting the height of the object by moving the elongated connecting member through the channel and releasably locking the elongated connecting member in the channel with a locking member of the first hanging device so that the object is fixed in a vertically position.

In another embodiment a kit of parts for hanging an object on a surface is provided. The kit includes an elongated connecting member, surface mounts configured to engage a surface on which the object is to be hung, at least one hanging device including a body portion, a channel portion a locking member and an attachment member, the channel passing through the body portion, the locking member protruding into the channel to releasably engage the elongated connecting member and the attachment being configured to attach the body portion to the object to be hung.

BRIEF DESCRIPTION OF THE DRAWINGS

The foregoing aspects and other features of the present embodiments are explained in the following description, taken in connection with the accompanying drawings, wherein.

DETAILED DESCRIPTION OF THE EXEMPLARY EMBODIMENT(s)

Figure 2A:
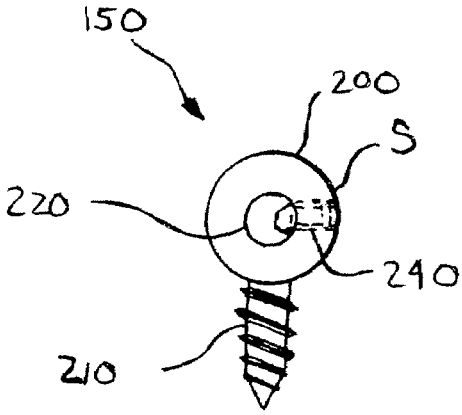
FIGS. 2A-B, 3A-B, 4A-B, 5A-C and 6A-B illustrate hanging devices in accordance with an exemplary embodiment.
Figure 2B:
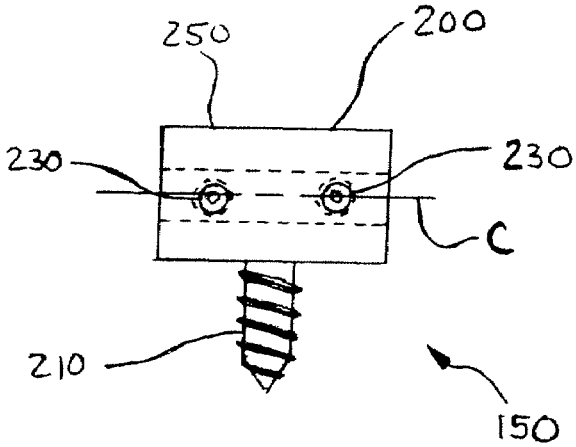

FIGS. 2A and 2B show an adjustable hanging device in accordance with an exemplary embodiment. Although the present embodiments will be described with reference to the exemplary embodiments shown in the drawings and described below, it should be understood that the present embodiments could be embodied in many alternate forms of embodiments. In addition, any suitable size, shape or type of elements or materials could be used.

Figure 3A:
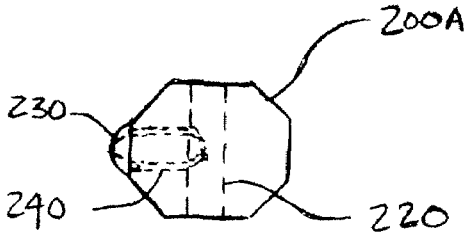
Figure 4A:
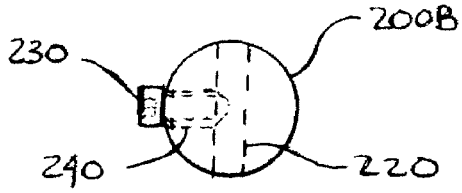
Figure 3B:
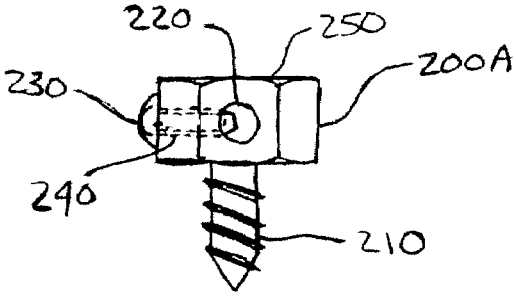
Figure 4B:
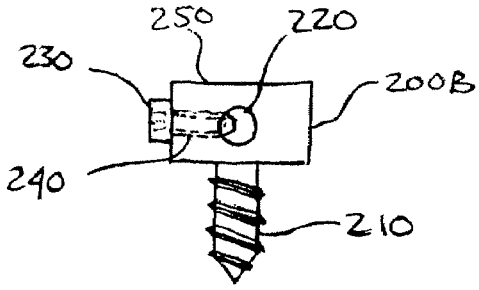
Figure 5A:
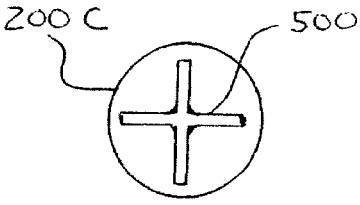
Figure 5B:
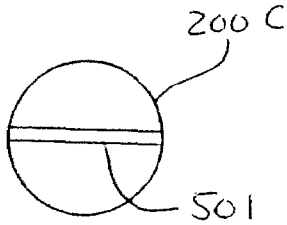
Figure 5C:
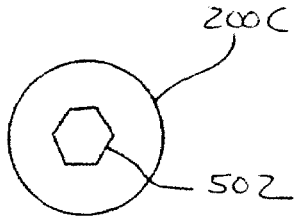

The adjustable hanging device 150 may be used to hang any suitable item on a surface and generally includes a body 200, a channel 220, at least one retaining device 230 and an attachment device 210. The hanging device 150 may be made of any suitable material such as, for example, a composite material, a metal material or a plastic material and be manufactured by any suitable method such as, for example, screw machines, injection molding, die casting, metal injection molding, powdered metal and the like. The body 200 of the hanging device is shown in FIGS. 2A and 2B as being cylindrical in shape. In alternate embodiments the body may be hexagonal (Ref. No. 200A as shown in FIGS. 3A and 3B), octagonal, circular (Ref. No. 200B as shown in FIGS. 4A and 4B), triangular, rectangular, square, oval or any other shape suitable for gripping and turning by a user's hand or, for example, a tool such as a wrench or pliers. The top surface 250 of the body 200 may also include slots or recesses as shown in FIGS. 5A-5C for engagement with a tool. For example, the top surface 250 of the body 200 may have grooves 500, 501, 502 configured to engage a Phillips head screwdriver, a flat head screwdriver or Allen wrench as respectively shown in FIGS. 5A-5C. In other embodiments, the top surface 250 of the body 200 may have any suitable engagement recesses including but not limited to slotted, Phillips, pozidrive, torx, hex, Robertson, tri-wing, torq-set, Frearson, BNAE (French recess) and spanner head drives. The body 200 of the hanging device 150 may be, for example, knurled, grooved or have any other suitable markings or features that would increase the amount of grip and torque that can be applied to the hanging device 150. The body 200 may also have any suitable dimensions such as diameter, length, height, width and the like.

The channel 220 runs, for example, lengthwise through the centerline C of the body 150. In alternate embodiments, the channel 220 may be located in any suitable location of the body 200 such as, for example, offset from the centerline C of the body 200. The channel 220 may also be cross-drilled into the body 200 so that the channel 220 is transverse to the centerline C. The channel 220 is shown in the Figures as having a circular cross-section but in alternate embodiments the channel may have any suitable cross-section including but not limited to square, triangular and oval cross sections. The channel 220 is of a suitable size to allow the passage of an elongated connecting member such as a cord, wire, string, cable, chain or any other suitable device 130 to pass through the channel 220. The channel 220 may provide any suitable amount of clearance between the channel 220 and, for example, the cord 130 so that the cord 130 passes easily through the channel 220. In alternate embodiments there may be some friction between the channel 220 and the cord 130 so that the cord passes through the channel 220 when pulled or pushed on.

The retaining device 230 may be any suitable retaining device including but not limited to a socket head cap screw, a set screw, a round head screw, a clip, a self-locking device, and a thumb screw. The retaining device 230 may or may not protrude above the surface S of the body 200. For example, where a screw type retaining device, thumb screw or clip is utilized, the retaining device 230 may be above the surface S when inserted into the receptacle 240. In alternate embodiments, the receptacle 240 may be countersunk or recessed in such a way so that the retaining device 230 does not protrude above the surface S of the body 200 when inserted into the receptacle 240.

The screw type retaining devices, for example, may have any suitable head style including but not limited to slotted, Phillips, pozidrive, torx, hex, Robertson, tri-wing, torq-set, Frearson, BNAE (French recess) and spanner head drive styles. For example, a hex head set screw is shown in FIGS. 2A and 2B, a button head screw with a Phillips drive is shown in FIGS. 3A and 3B, while a socket head (e.g. hex drive) cap screw is shown in FIGS. 4A and 4B. With respect to the thumb screw, the head of the thumb screw may have any suitable gripping pattern, such as for example scallops, raised groves or knurls to allow gripping and turning of the thumb screw. The receptacle 240 may be, for example, a tapped hole or any other suitable opening for accepting the retaining device 230. The receptacle 240 may be configured so that it is perpendicular to the channel 220 or at an angle to the channel 220. When the screw type retaining devices are inserted into the receptacle 240 the tip of the retaining device protrudes into the channel 220, as can be seen in FIGS. 2A, 3B and 4B, to secure the elongated connecting member such as cord 130.

Figure 6A:
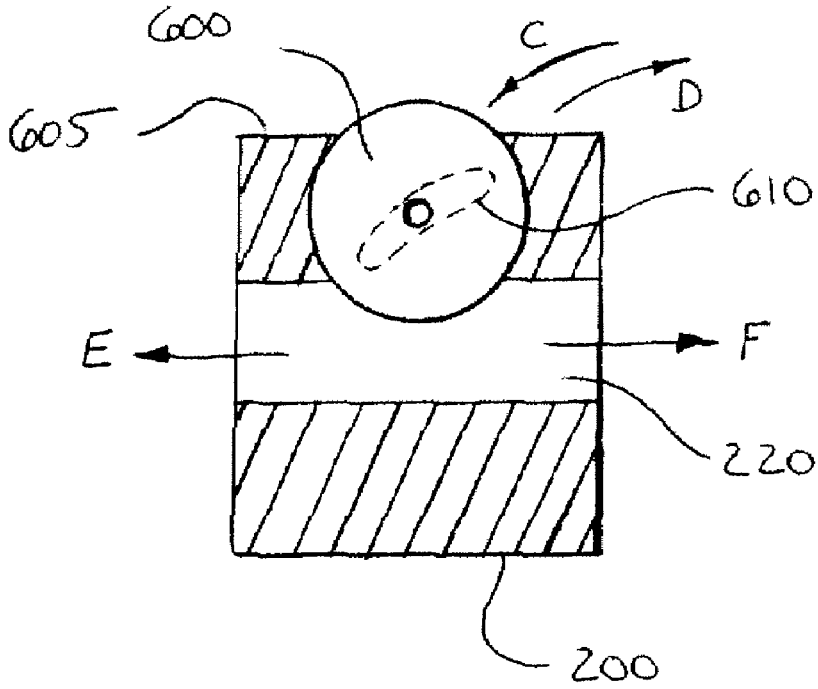
Figure 6B:
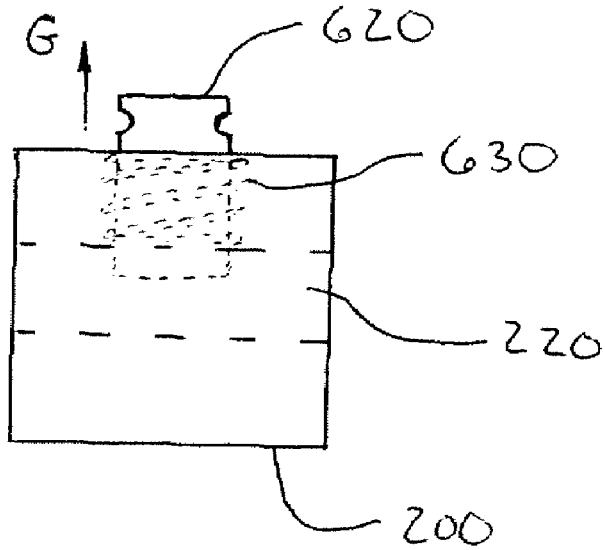

In other embodiments, a self-locking retaining device may be incorporated into the body 200 to automatically lock, for example, the cord 130 inside the channel 220. The self-locking devices include but are not limited to cam locking mechanisms, spring locking mechanisms and ratcheting mechanisms. For example, as can be seen in FIG. 6A the self-locking retaining device may be configured to allow the cord 130 to pass through the device in one direction while locking the cord 130 from passing through the device in the opposite direction. In FIG. 6A when the cord 130 is pulled through channel 220 in the direction of arrow F the friction wheel 600 follows cam slot 610 so that the friction wheel 600 travels in the direction of arrow D allowing the cord 130 to pass through the channel. When the cord is pulled in the direction of arrow E the friction wheel travels in the direction of arrow C which wedges or otherwise restrains the cord 130 from passing through the channel 220 in the direction of arrow E. In another example, the retaining device may be spring loaded to protrude into the channel 220 as shown in FIG. 6B. In FIG. 6B to allow the cord 130 to pass through the channel 220, plunger 620 can be pulled outward (e.g. at least partially out of the channel 220) in the direction of arrow G so that the cord is not restricted from passing through the channel 220. When the plunger 620 is released the spring 630 forces the plunger into engagement with the cord 130 to prevent movement of the cord 130 in the channel 220. In alternate embodiments the plunger may be configured to be pushed inward to release the cord 130. In other embodiments any suitable self-locking mechanism may be utilized. The self-locking retaining device may be provided with a release mechanism so a user may easily remove the cord 130 if desired. For example, as can be seen in FIG. 6A, the friction wheel 600 protrudes above the surface 605 of the body 200 so that a user can move the wheel 600 in the direction of arrow D to release the cord 130. Any suitable number of retaining devices 230 may be used in the hanging device 150 such as for example, two retaining devices 230 are shown in FIG. 2B while one retaining device 230 is shown in FIGS. 3B and 4B.

The attachment device 210 may be any suitable device for attaching the hanging device 150 to the item to be hung. The attachment device 210 can be configured to attach to any suitable material including but not limited to wood, metal, plastic and glass. For example, the attachment device 210 may be in the form of a wood screw as shown in the Figures, a machine screw, a clip, a snap, a magnet, a mechanical adhesive or a chemical adhesive. The attachment device 210 may have any suitable length, diameter or adhesive properties. Where the attachment device 210 is in the form of, for example, a screw, snap or clip it may be of unitary construction with the body 200 (i.e. manufactured as part of the body) or it may be press fit into the body 200. In alternate embodiments the attachment device 210 may be connected to the body 200 in any suitable manner so that the attachment device 210 can be inserted into the item to be hung by, for example, turning the body 200 with an appropriate tool (e.g. screwdriver, wrench, etc.). Where a chemical or mechanical adhesive is applied, the adhesive may be mounted on a base. The base may be attached to the body 200 so that the base swivels to allow the body 200 to rotate to a desired position when the adhesive is attached to the item to be hung. In other embodiments the adhesive may be applied directly to the body 200.

Figure 1:
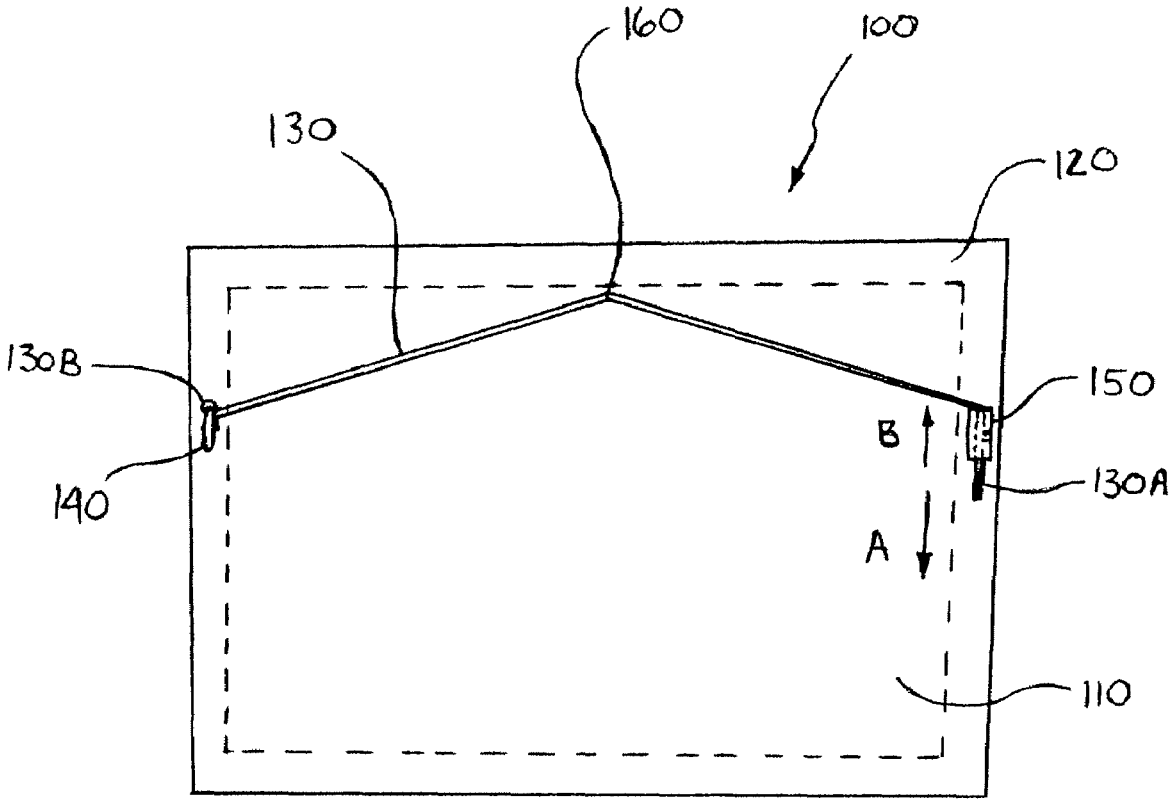
FIG. 1 illustrates an assembled hanging device in accordance with an exemplary embodiment.
Figure 7:
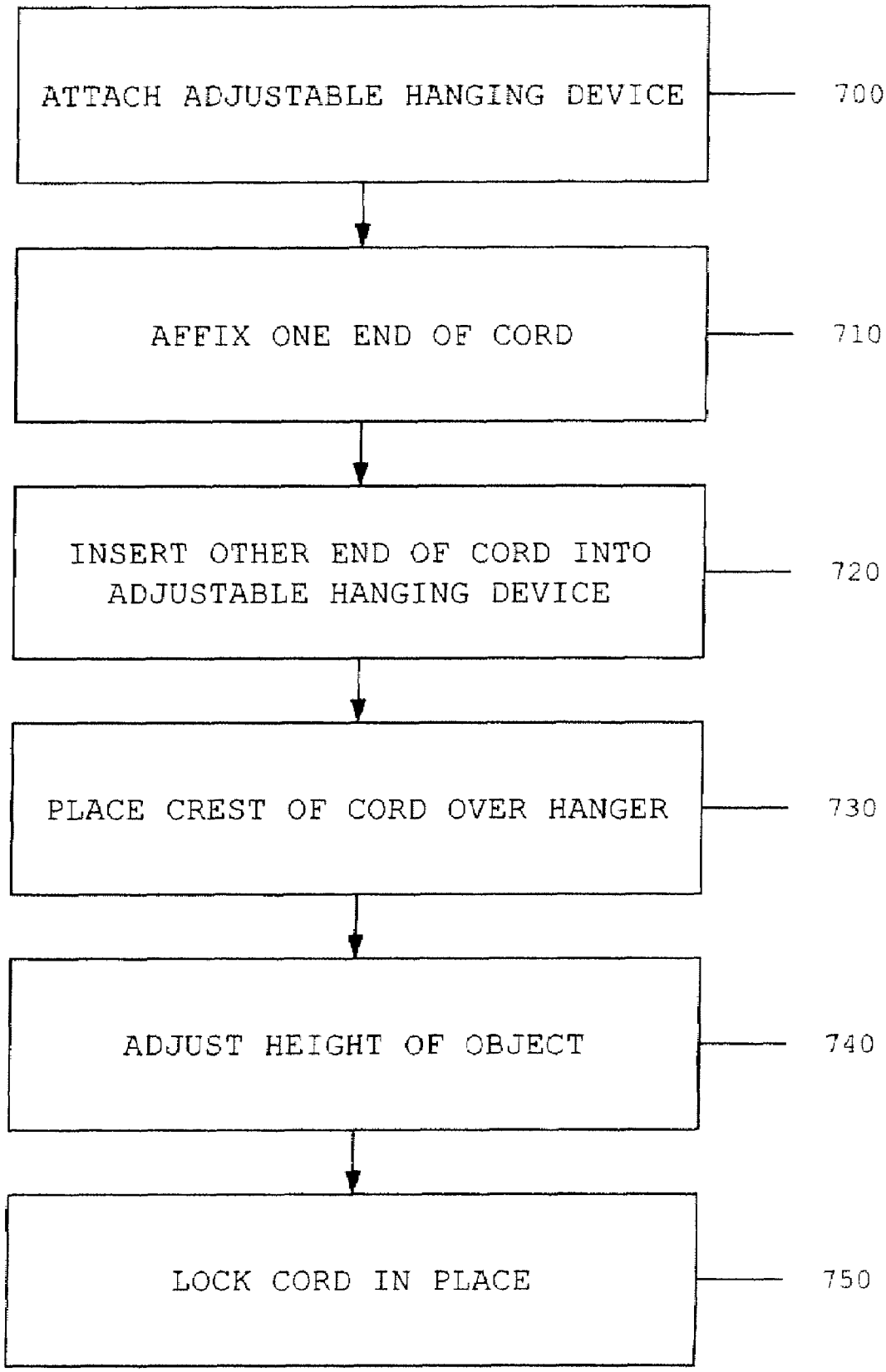
FIG. 7 is a flow diagram of a method in accordance with an embodiment.

In operation, as can be seen in FIG. 1, a user may attach the adjustable hanging device 150 to, for example, the back of a picture frame 100 or any other suitable item so that the attachment device passes through the frame backing 110 and into the frame structure 120 (FIG. 7, Block 700). The user may attach, for example, an eye screw 140 or any other suitable attachment device on one side of the frame 100 and the adjustable hanging device 150 on the other side of the frame 100. In other embodiments the user may attach two adjustable hanging devices 150 on either side of the frame 100. Where, for example, an eye screw 140 or any other suitable device is used the hanging device 150 may be configured to have the same height as the eye screw or other device so that the bottom of the picture sits flat against the surface of, for example, a wall. A user may tie or otherwise affix, for example, one end 130B of the cord 130 to the eye of the eye screw 140 or insert the cord 130 into and/or through one of the adjustable hanging devices 150 (FIG. 7, Block 710). Where two hanging devices 150 are used, the cord 130 may have, for example, a ball (not shown) or any other suitable blocking device fixed to one end of the cord. The blocking device may prevent the cord from passing through the channel 220 of the hanging device 150. A user may insert, for example, one end 130B of the cord 130 through the channel 220 of one of the hanging devices 150 until the blocking device stops movement of the cord through the channel 220. In alternate embodiments, the user may lock the cord in place with the retaining device 230. The user takes the other end 130A of the cord 130 an inserts it into the channel 220 of the other hanging device 150 (FIG. 7, Block 720). The user places the picture frame against, for example, a wall so that the crest 160 of the cord 130 is placed over a nail, screw or other suitable hanger that has been inserted into the wall or over an existing mounting point (collectively referred to herein as mounting points) (FIG. 7, Block 730). The user may adjust the height of the picture frame 100 on the wall by pulling the end 130A through the hanging device 150 in the direction of arrow A to raise the frame 100. The user may lower the frame by releasing the end 130A so that the cord 130 passes through the hanging device 150 in the direction of arrow B. (FIG. 7, Block 740). When the frame 100 is at the desired height the user may lock the cord 130 in place with the retaining device 230 (FIG. 7, Block 750). In other embodiments the retaining device 230 of the adjustable hanging device 150 may be configured to automatically lock the cord in place.

Figure 8:
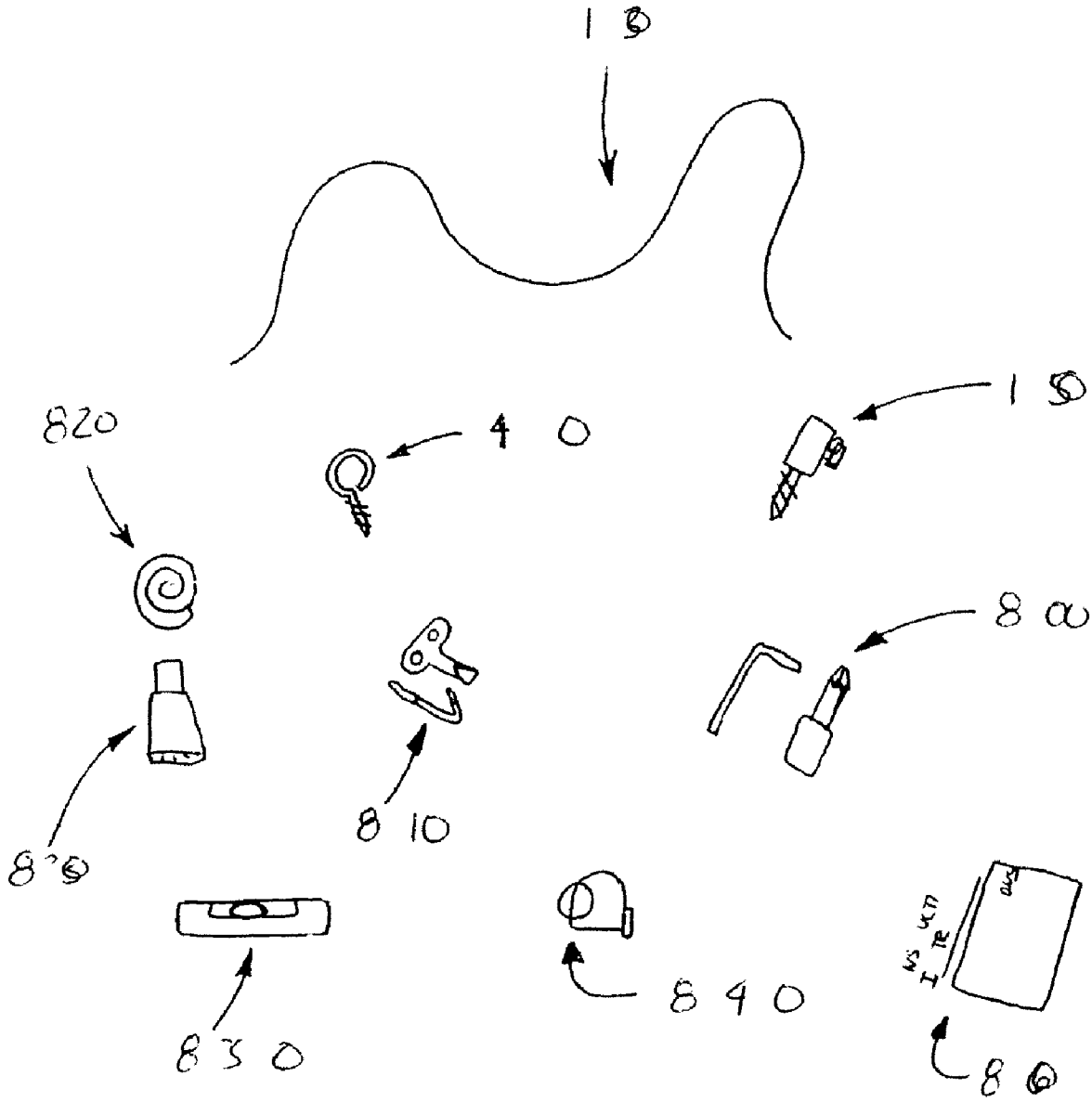
FIG. 8 illustrates a kit in accordance with an embodiment.

The adjustable hanging device 150 may be provided to users as individual pieces or in a kit. For example, referring to FIG. 8, the kit may include any suitable items such as any combination of one or more adjustable hanging devices 150, an eye screw 140, a cord 130, a tool 800 (including but not limited to screwdrivers and wrenches) to affix the hanging device 150 to the item to be hung and to tighten the retaining device 230, one or more hangers or hooks 810 to affix to the wall or other surface for engaging the cord 130, mechanical or chemical adhesive 820, 830 including but not limited to tapes, glues and epoxies, a tape measure 840, a level 850 and an instruction booklet 860. The instruction booklet may include step by step instructions on how to hang an item on a wall or other surface.

The adjustable hanging device 150 allows a user to hang any item on a surface such as a wall quickly and easily without having to make several undesired holes in the surface to obtain a proper height of the item. The adjustable hanging device also allows for adjusting the height of an item being placed on the surface so that the item is aligned with other items mounted on that surface or to achieve a desired height without guessing as to what length of cord is needed to obtain the desired height.

It is noted that the size of the adjustable hanging device 150 and cord can be scaled up or down to accommodate any size and weight of an item that is to be hung on a surface. Multiple sets of hanging devices 150 and cords can also be utilized to hang an item on a surface.

It should be understood that the foregoing description is only illustrative of the embodiments. Various alternatives and modifications can be devised by those skilled in the art without departing from the embodiments. Accordingly, the present embodiments are intended to embrace all such alternatives, modifications and variances.

What is claimed is:

1. A device for hanging an object on a surface, the device comprising:

a cylindrical body portion having a cylindrical axis;

a channel passing through the body portion configured to receive an elongated connecting member;

a locking member protruding into the channel, the locking member being configured to releasably engage the elongated connecting member and configured to prevent the elongated connecting member from passing through the channel when engaged; and an attachment member being of unitary one piece construction with the cylindrical body portion and extending from the cylindrical body portion such that a longitudinal axis of the attachment member is substantially inline with the cylindrical axis, the attachment member being configured to attach the cylindrical body portion to the object to be hung, wherein the locking member is substantially perpendicular to the longitudinal axis of the attachment member.

2. The device of claim 1, wherein a surface of the body portion includes slots or recesses configured to engage a tool for affixing the device to the object to be hung.

3. The device of claim 2, wherein the slots or recesses are configured as slotted, Phillips, pozidrive, torx, hex, Robertson, tri-wing, torq-set, Frearson, French recess and spanner head drives.

4. The device of claim 1, wherein the body includes knurls and/or grooves configured to maximize an amount of grip and torque that can be applied to the device.

5. The device of claim 1, wherein the channel is configured to run lengthwise through a centerline of the body portion.

6. The device of claim 1, wherein the channel is configured to run transverse to a centerline of the body portion.

7. The device of claim 1, wherein the attachment member is a wood screw, a machine screw, a clip, a snap, a magnet, a mechanical adhesive or a chemical adhesive.

8. The device of claim 1, wherein the locking member includes one or more of a socket head cap screw, a set screw, a round head screw, a clip, a self-locking device, and a thumb screw.

9. The device of claim 8, wherein the self-locking device includes a ratcheting member, a cam actuated member or resilient member.

10. A method of hanging an object on a surface comprising:

attaching a first hanging device to an object to be hung with an attachment member, wherein the hanging device includes a cylindrical body portion of unitary construction with the attachment member and having a cylindrical axis substantially inline with a longitudinal axis of the attachment member;

affixing a first end of the elongated connecting member to the object to be hung;

inserting a second end of the elongated connecting member into a channel of the first hanging device;

placing a crest of the elongated connecting member over a mounting point located on a surface for hanging the object;

adjusting the height of the object by moving the elongated connecting member through the channel; and releasably locking the elongated connecting member in the channel with a locking member of the first hanging device, where the locking member is substantially perpendicular to the longitudinal axis of the attachment member, so that the object is fixed in a vertical position.

11. The method of claim 10, wherein affixing a first end of the elongated connecting member to the object to be hung comprises, affixing the elongated connecting member to an eye of an eye screw inserted into the object to be hung.

12. The method of claim 10, wherein affixing a first end of the elongated connecting member to the object to be hung comprises, inserting the elongated connecting member into a channel of a second hanging device affixed to the object to be hung and releasably locking the elongated connecting member in the channel with a locking member of the second hanging device.

13. The method of claim 10, wherein releasably locking the elongated connecting member in the includes tightening one or more of a socket head cap screw, a set screw, a round head screw, a clip, and a thumb screw or engaging a self-locking device, wherein the self-locking device includes a ratcheting member, a cam actuated member or resilient member.

14. A kit of parts for hanging an object on a surface, the kit comprising:

an elongated connecting member;

surface mounts configured to engage a surface on which the object is to be hung; and at least one hanging device comprising a cylindrical body portion having a cylindrical axis, a channel portion a locking member and an attachment member, the channel passing through the body portion, the locking member protruding into the channel to releasably engage the elongated connecting member and the attachment member being of unitary one piece construction with the cylindrical body portion and configured to attach the body portion to the object to be hung, wherein a longitudinal axis of the attachment member is substantially inline with the cylindrical axis and the locking member is substantially perpendicular to the longitudinal axis of the attachment member.

15. The kit of claim 14, further comprising a tool configured to engage the at least one hanging device for attaching the at least one hanging device to the object to be hung.

16. The kit of claim 15, wherein the tool comprises a slotted, Phillips, pozidrive, torx, hex, Robertson, tri-wing, torq-set, Frearson, French recess or spanner head drive.

17. The kit of claim 14, further comprising a chemical or mechanical adhesive configured to affix the at least one hanging device to the object to be hung.

18. The kit of claim 14, further comprising a tape measure.

19. The kit of claim 14, further comprising an instruction sheet, book or booklet.

20. The kit of claim 14, further comprising a level.

* * * * *